US007942273B2

(12) United States Patent
Campbell et al.

(10) Patent No.: US 7,942,273 B2
(45) Date of Patent: May 17, 2011

(54) CROSS FLOW AIR SEPARATION SYSTEM

(75) Inventors: Dane Campbell, Eugene, OR (US); Roy Miller, Eugene, OR (US); Steve Miller, Eugene, OR (US)

(73) Assignee: Emerging Acquisitions, LLC, Eugene, OR (US)

( * ) Notice: Subject to any disclaimer, the term of this patent is extended or adjusted under 35 U.S.C. 154(b) by 152 days.

(21) Appl. No.: 12/247,196

(22) Filed: Oct. 7, 2008

(65) Prior Publication Data

US 2010/0084323 A1 Apr. 8, 2010

(51) Int. Cl.
*B07C 5/38* (2006.01)

(52) U.S. Cl. ..... 209/631; 209/44.2; 209/139.1; 209/552; 209/555

(58) Field of Classification Search ..... 209/44.2, 209/139.1, 552, 555, 571, 631, 638, 639, 209/644, 698

See application file for complete search history.

(56) References Cited

U.S. PATENT DOCUMENTS

| | | | |
|---|---|---|---|
| 1,679,593 | A | 8/1928 | Williamson et al. |
| 1,913,876 | A | 6/1933 | Frederick |
| 2,949,187 | A | 8/1960 | Owens |
| 3,013,662 | A | 12/1961 | Philips |
| 3,143,492 | A | 8/1964 | Bullock |
| 3,431,139 | A | 3/1969 | Stroszynski |
| 3,477,566 | A | 11/1969 | Autenrieth et al. |
| 3,545,746 | A | 12/1970 | Clayton et al. |
| 3,643,797 | A | 2/1972 | Berkowitz et al. |
| 3,738,483 | A | 6/1973 | MacKenzie |
| 3,788,568 | A | 1/1974 | Marsh |
| 3,873,033 | A | 3/1975 | Tilby |
| 4,087,177 | A | 5/1978 | Gumm et al. |
| 4,092,241 | A | 5/1978 | Mackenzie et al. |
| 4,155,602 | A | 5/1979 | Quick |
| 4,202,542 | A | 5/1980 | Lammers et al. |
| 4,352,731 | A | 10/1982 | Moudgil et al. |
| 4,377,401 | A | 3/1983 | Laughlin |
| 4,466,605 | A | 8/1984 | Leuthold et al. |

(Continued)

FOREIGN PATENT DOCUMENTS

DE 4415069 11/1994

(Continued)

OTHER PUBLICATIONS

Nihot, Solutions in air-controlled separation, The Nihot Windshifter, Catalog.

(Continued)

*Primary Examiner* — Terrell H Matthews
(74) *Attorney, Agent, or Firm* — Stolowitz Ford Cowger LLP

(57) ABSTRACT

A cross-flow air separation system comprises a conveyor configured to project material out over an end of the conveyor generally along a trajectory path into a far receiving bin. An optical sensing system is configured to identify particular objects in the projected material. A first air ejection system is configured to generate a first airstream that ejects the identified objects from the trajectory path into a second near receiving bin. A second cross air current system is configured to generate a second airstream that reduces air resistance for the materials projected along the trajectory path. The second airstream reduces certain aeronautic phenomena that would cause some of the projected materials to unintentionally fall into the wrong receiving bin, thus creating a higher purity/less contaminated materiel stream into the near bin.

20 Claims, 7 Drawing Sheets

U.S. PATENT DOCUMENTS

| | | | | | |
|---|---|---|---|---|---|
| 4,685,569 | A | | 8/1987 | Osaki et al. | |
| 4,789,068 | A | | 12/1988 | Gilmore | |
| 4,798,508 | A | | 1/1989 | Lewis | |
| 4,853,112 | A | | 8/1989 | Brown | |
| 4,895,642 | A | | 1/1990 | Frei | |
| 4,915,824 | A | | 4/1990 | Surtees | |
| 4,946,046 | A | | 8/1990 | Affleck et al. | |
| 5,025,929 | A | | 6/1991 | Carrera | |
| 5,074,992 | A | | 12/1991 | Clinton | |
| 5,344,025 | A | | 9/1994 | Tyler et al. | |
| 5,361,909 | A | | 11/1994 | Gemmer | |
| 5,450,966 | A | | 9/1995 | Clark et al. | |
| 5,506,123 | A | | 4/1996 | Chieffalo et al. | |
| 5,733,592 | A | | 3/1998 | Wettstein et al. | |
| 5,799,801 | A | | 9/1998 | Clark et al. | |
| 5,901,856 | A | | 5/1999 | Brantley et al. | |
| 5,913,268 | A | | 6/1999 | Jackson et al. | |
| 5,957,306 | A | * | 9/1999 | Hoffman | 209/587 |
| 5,960,964 | A | | 10/1999 | Austin et al. | |
| 5,967,333 | A | | 10/1999 | Smith | |
| 6,003,681 | A | * | 12/1999 | Wilbur et al. | 209/639 |
| RE36,537 | E | * | 2/2000 | Sommer et al. | 209/576 |
| 6,076,684 | A | | 6/2000 | Bollegraaf | |
| 6,077,021 | A | | 6/2000 | Roman | |
| 6,079,929 | A | | 6/2000 | Muma et al. | |
| 6,089,814 | A | | 7/2000 | Bayer | |
| 6,110,242 | A | | 8/2000 | Young | |
| 6,144,004 | A | * | 11/2000 | Doak | 209/581 |
| 6,149,018 | A | | 11/2000 | Austin et al. | |
| 6,250,472 | B1 | * | 6/2001 | Grubbs et al. | 209/44.2 |
| 6,253,924 | B1 | | 7/2001 | Bleifuss et al. | |
| 6,253,927 | B1 | | 7/2001 | Vaananen et al. | |
| 6,365,857 | B1 | | 4/2002 | Maehata et al. | |
| 6,371,305 | B1 | | 4/2002 | Austin et al. | |
| 6,726,028 | B2 | | 4/2004 | Visscher et al. | |
| 6,903,294 | B1 | | 6/2005 | Daiku et al. | |
| 6,936,784 | B2 | * | 8/2005 | Ogburn et al. | 209/576 |
| 7,237,680 | B2 | | 7/2007 | Viny | |
| 2003/0116486 | A1 | | 6/2003 | Davis | |
| 2004/0069693 | A1 | | 4/2004 | Paladin | |
| 2007/0084757 | A1 | | 4/2007 | Jeon et al. | |

FOREIGN PATENT DOCUMENTS

| | | |
|---|---|---|
| EP | 0546442 | 6/1993 |
| EP | 0773070 | 5/1997 |

OTHER PUBLICATIONS

Nihot, Sort it out with air, The Nihot Drum Separators, Catalog.

International Search Report; PCT/US2008/054621; Dated Sep. 16, 2008.

* cited by examiner

CROSS FLOW AIR SEPARATION SYSTEM

BACKGROUND

An optical sensor is used to identify particular materials carried on a conveyor belt. The material is launched off the end of the conveyor and travels along a trajectory path into a far bin. Particular objects identified by the optical sensor are knocked out of their normal trajectory into a different near bin via a blast of air from a high pressure air nozzle.

SUMMARY

A cross-flow air separation system comprises a conveyor configured to project material out over an end of the conveyor generally along a trajectory path into a far receiving bin. An optical sensing system is configured to identify particular objects in the projected material. The primary air ejection system, which operates perpendicular to the material flow, is configured to eject identified objects from the trajectory path into the near receiving bin. A second cross air current system is configured to generate a second airstream parallel to the material flow that reduces air resistance for the materials projected along the trajectory path. The second airstream reduces certain aeronautic phenomena that would cause some of the projected materials to unintentionally fall into the wrong receiving bin.

DETAILED DESCRIPTION

Figure 1:
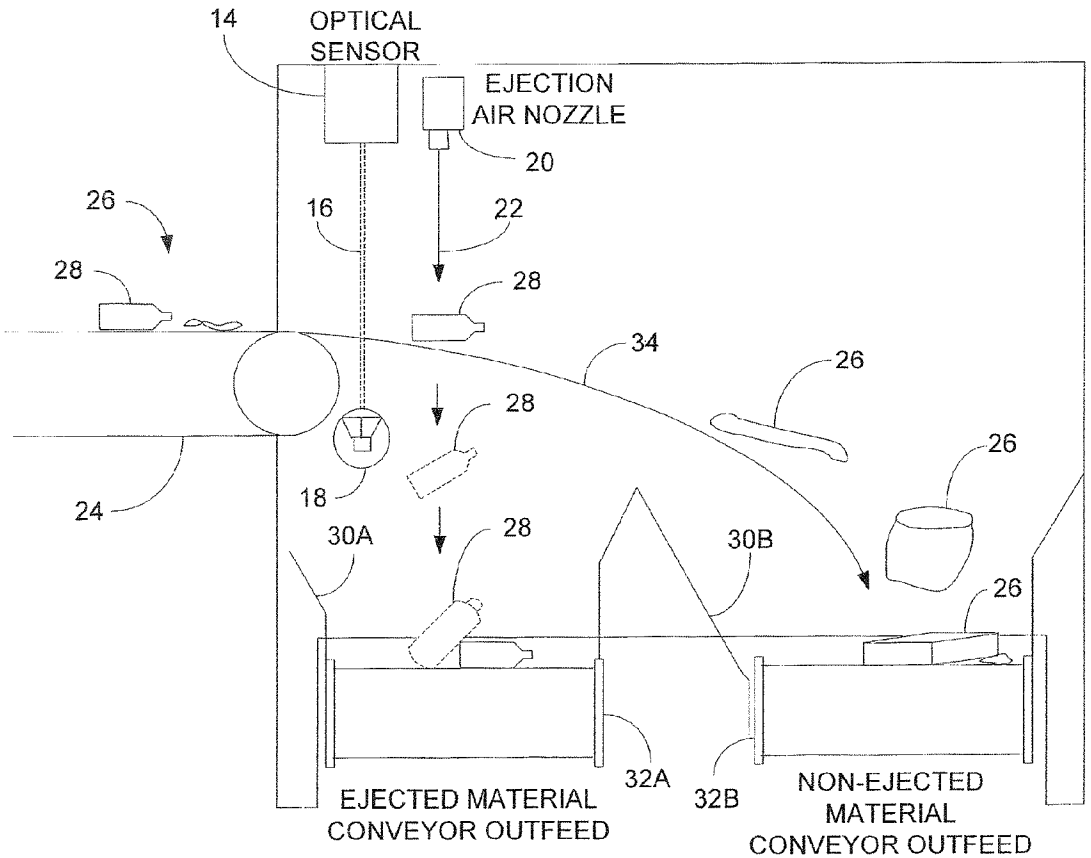
FIG. 1 is a side view of an optical air separation system used for separating plastic containers from other objects in a material stream.

FIG. 1 shows a schematic diagram of an optical air separation system 12. A conveyor 24 carries different materials 26 that, in one example, may comprise Municipal Solid Waste (MSW) or may comprise primarily recyclable materials 26 referred to generally as a single stream. The single stream may include plastic, aluminum, steel, and glass containers and objects and may also include paper and Old Corrugated Cardboard (OCC). The MSW may contain these recyclable materials as well as other materials such as textiles, food waste, yard debris, wood, concrete, rocks, etc. Any MSW stream, single stream, or any other materials that may need to be separated are referred to generally below as a material stream.

It may be desirable to separate certain objects or materials from the material stream 26. For example, plastic, aluminum, steel, and glass objects may need to be separated from other recyclable or non-recyclable materials, such as paper, Old Corrugated Cardboard (OCC), textiles, food waste, yard debris, wood, concrete, rocks, etc. Further, the different plastic, aluminum, steel, and glass objects may all need to be separated. In one example described below, polyethylene terephthalate (PET) and/or high density polyethylene (HDPE) objects 28 are separated from other materials in material stream 26. Of course, any variety of different objects 28 may need to be separated from the rest of material stream 26.

Theoretically based on gravity and conveyor speed, all the materials 26 would be projected from conveyor 24 at the same speed and travel generally along the same trajectory path 34. With this information a computer system (not shown) attached to optical sensor 14 can detect and calculate the location of different objects 28 after being projected through the air off the end of the conveyor 24.

The speed of conveyor 24 is selected so that all of the materials 26 are launched out over the end of conveyor 24 into a far bin 30B and onto a conveyor 32B. The optical sensor 14 is programmed via software in the computer system to detect the shape, type of material, color or levels of translucence of particular objects 28. For example, the computer system connected to optical sensor 14 may be programmed to detect the type of plastic material associated with plastic bottles.

Any objects 28 having the preprogrammed types of materials are detected by the optical sensor 14 when passing through a light beam 16. The computer system connected to the optical sensor 14 sends a signal activating a high pressure ejection air nozzle 20. The ejection nozzle 20 releases a blast of air 22 that knocks the detected objects 28 downward out of normal trajectory path 34 into near bin 30A and onto conveyor 32A. The other materials 28 continue to travel along trajectory path 34 into the far bin 30B and onto conveyor 32B.

Figure 2:
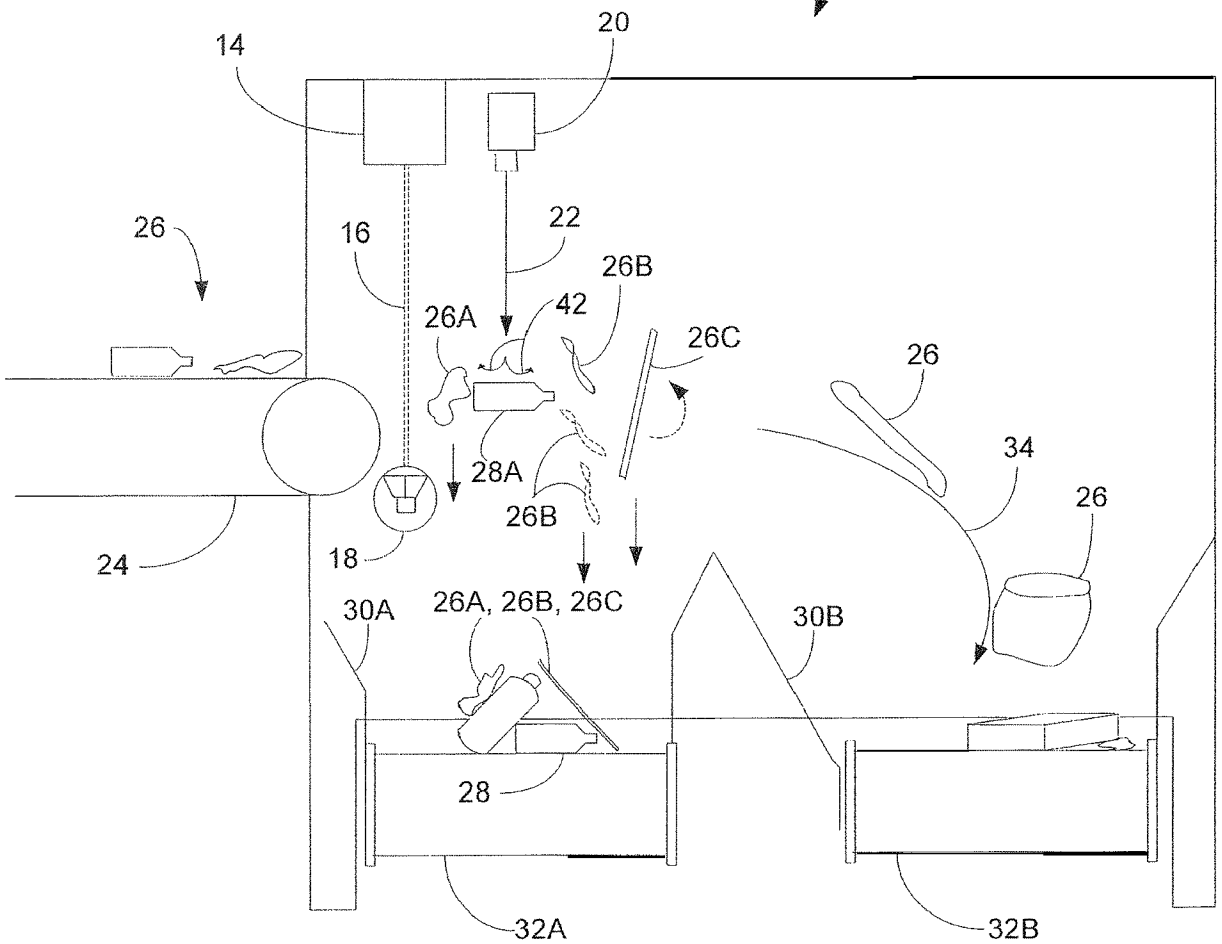
FIG. 2 shows some of the problems associated with the optical air separation system shown in FIG. 1.

Referring to FIG. 2, theoretically, all of the materials 26 should move along the same trajectory path 34. However, in reality different materials 26 "fly" off of the conveyor 24 differently for several different reasons. For example, pieces of paper, cardboard, or Styrofoam 26C may have aerodynamic characteristics that due to air resistance cause those objects to flip upward, flip downward, or just generally drift downward after being launched from conveyor 24. The air resistance experienced by these objects (lack of aerodynamics), causes the paper, cardboard, or Styrofoam 26C to deviate from the normal trajectory path 34 and fall short into the near bin 30A.

The projection of objects 26 and/or air blasts 22 may also create air turbulence 42 that alters the normal trajectory path 34 of other objects 26B. For example, the air disturbance 42 may push down, raise up, or tumble relatively light objects 26B. This air disturbance 42 causes the objects 26B to deviate out of the normal trajectory path 34 and unintentionally drop into the near bin 30A.

Other objects may collide into each other while being launched from conveyor 24. For example, an object 26A may run into or slightly attach onto bottle 28A while being projected from conveyor 24. The frictional force created when object 26A comes in contact with the bottle 28A may cause object 26A to deviate out of trajectory path 34 and unintentionally drop into near bin 30A.

The optical air separation system 12 may also use large bins 30A and 30B to catch the different separated materials 28 and 26, respectively. One possible disadvantage of large bins is that slight variances in the normal trajectory path 34 can cause objects to fall into the wrong bins. Accordingly, any of the trajectory disturbances described above are more likely to cause material to fall into the wrong bin.

Cross Flow Air Separation

Figure 3:
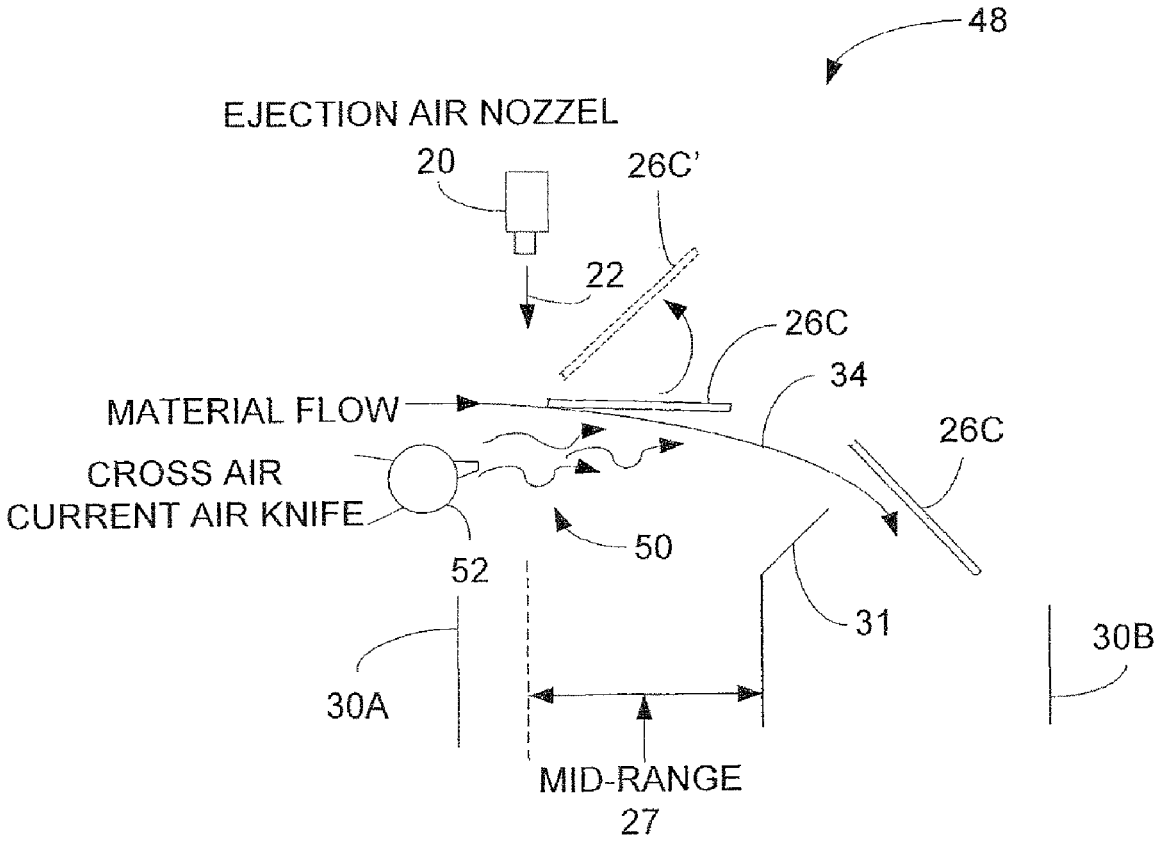
FIG. 3 is an isolated side view of a cross flow air separation system.

FIG. 3 shows a cross air current system 48 that improves the consistency of material separation. The cross air current system 48 includes an air nozzle 52, alternatively referred to as an "air knife," that creates a cross air current 50 in a direction generally along the trajectory path 34. The cross air current 50 reduces at least some of the air resistance that material 26 normally experiences after being projected from the conveyor 24 (FIG. 2). The positive airstream provided by the cross air current helps material 26 travel along the desired trajectory path 34, thus counteracting some of the trajectory deviation problems described above.

As described above, one cause of trajectory path deviation is the different aerodynamic characteristics of the different materials 26. The cross air current 50 prevents these projected materials from having to fight dead air, which equates to wind resistance or lack of aerodynamics. As previously shown in FIG. 2, dead air resistance caused certain objects such as paper, cardboard, or Styrofoam 26C' to flip vertically upward, flip vertically downward, or simply run out of speed after being projected off the end of conveyor 24 (FIG. 2). The increased air resistance caused these objects 26C to lose speed and incorrectly drop into near bin 30A.

However, the cross air current 50 shown in FIG. 3 removes at least some of this dead air resistance and as a result, the paper, cardboard, Styrofoam, etc. 26C is less likely to flip and/or run out of speed after being projected from conveyor 24. Instead, the cross air current 50 allows the paper, cardboard, or Styrofoam 26C to maintain theoretical aerodynamic characteristics and continue along trajectory path 34 into the correct far bin 30B.

In certain embodiments, the speed of material 26 coming off of conveyor 24 and the corresponding speed of cross air current 50 may both be between 7-12 feet per second (FPS). It has been discovered that approximately 10 FPS on the infeed material conveyor 24 provides good separation of material into a single layer as the material 26 is being carried and launched off of conveyor 24. The 10 FPS projection speed also provides controlled launching of the material 26 along trajectory path 34. Of course other conveyor speeds and cross air current speeds may be used depending on the material being separated and the configuration of the cross air current system 48.

In one embodiment, the air knife 52 generates a cross air current 50 that is either substantially parallel to the trajectory path 34, in line with the trajectory path 34, or possibly in a slightly upward intersecting direction with trajectory path 34. The air nozzle 52 can be rotated or moved so that the cross air current 50 is aligned in a variety of different directions with respect to trajectory path 34. The alignment of air current 50 in relationship to trajectory path 34 may be changed according to the type of materials 26 that need to be separated, the speed of conveyor 24, the height of the conveyor 24 above bins 30, the size of bins 30, etc.

In one embodiment, the mid-range airspeed of cross air current 50 is approximately equal to the mid-range travel speed of material 26. The location 27 of the mid-range airspeed is approximately half way between the air bar 22 where the ejection air nozzle 20 blasts downward air pressure and the splitter plate 31 that separates the first near bin 30A (FIG. 4) from the far bin 30B (FIG. 4).

The speed of air, coming off the face of the air knife 52 is much faster than 10 FPS. This is required due to the compressibility of air which creates exponential reduction in speed compared to distance off the air knife face. It has been discovered that air speeds of 20,000 to 30,000 FPS with air knife system pressures of 25-35 inches of water provide the necessary force and speeds to properly interface with the material traveling at 10 FPS off the end of the conveyor. Thus the air speed off the face of the air knife may have to be faster than the mid-range air speed, in order to obtain the desired air speed at location 27. Of course, these speeds and pressures can vary in different embodiments according to the types of materials that need to be separated.

Figure 4:
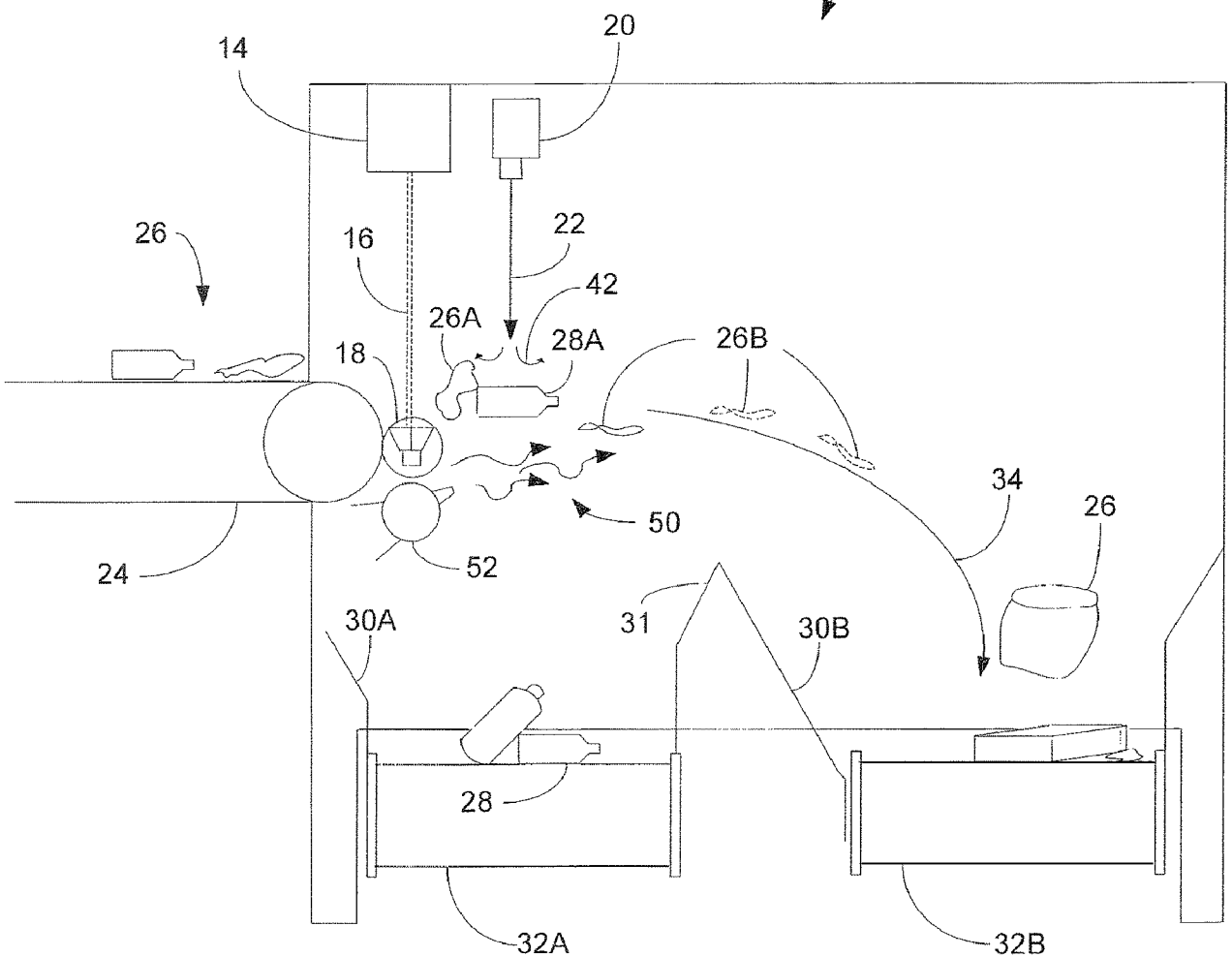
FIG. 4 is a more detailed side view of the cross flow air separation system shown in FIG. 3.

Referring to FIG. 4, in this example, the cross air current system 48 separates polyethylene terephthalate (PET) and/or high density polyethylene (HDPE) bottles, jugs, containers, etc. 28 from other objects in material stream 26 or comingled recyclable material stream. However, it should again be understood that the cross air separation system 48 can be used to separate any detectable object from a material stream.

Another trajectory issue described above in FIG. 2 relates to air turbulence created by the air 22 blasted out of air ejection nozzle 20 and created by objects projected out from conveyor 24. As described above in FIG. 2, there was previously very little continuous air flow around the ejection area at the end of conveyor 24. As a result, the projection of materials 26 and the air blasts 22 created a substantial amount of air turbulence 42. This air turbulence 42 disrupted the normal trajectory path 34 of some lighter materials 26B and caused those materials to incorrectly fall into the near bin 30A.

The cross air current 50 creates a layer of continuously flowing air that effectively blazes a path through the air turbulence 42 allowing the material 26B to continue along trajectory path 34 into the correct far bin 30B. The cross air current 50 effectively carries away some of the air turbulence 42 resulting in more surgical, higher precision blasts of air 22 from ejection air nozzle 20. An analogy would be throwing a rock into a quiet pond versus throwing a rock in a swift river. The rock creates large wide spreading ripples in the quiet pond. However, the rock creates much less noticeable disturbance in the swift river.

The air blasts 22 generated by the ejection air nozzle 20 have more force than the cross air current 50. Therefore, the air blasts 22 can still blast through the cross air current 50 and push certain detected objects 28A downward into the near bin 30A. At the same time, the material 26 around the ejected object 28A is more insulated from the air blasts 22 by the layer of cross air current 50 and is therefore less likely to deviate out of trajectory path 34.

Figure 5:
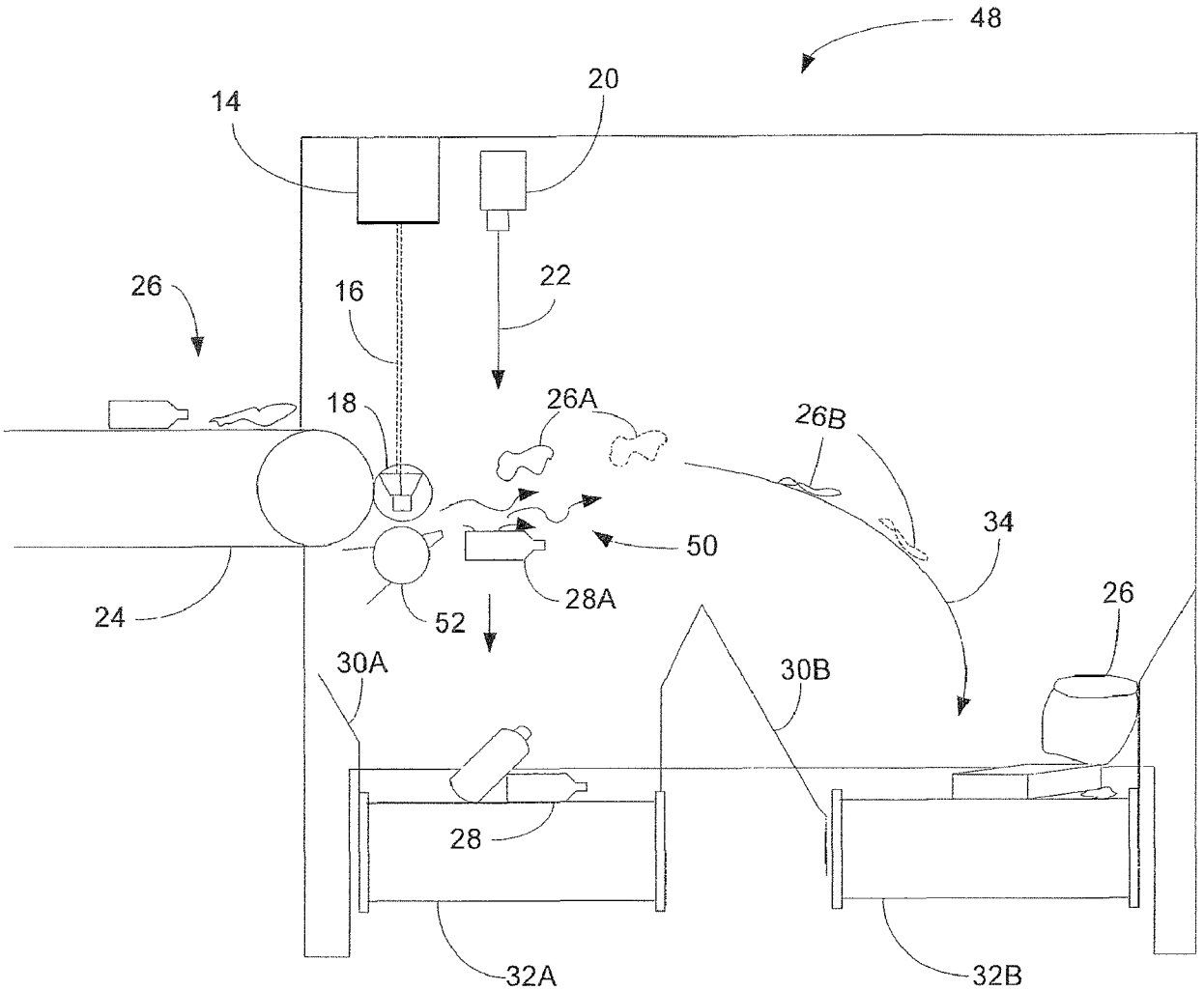
FIG. 5 is another side view showing how the cross flow air separation system reduces air resistance and reduces collision friction for projected materials.

FIG. 5 shows how cross air current 50 compensates for "friction forces" that might exist between different projected materials 26. For example, as previously described in FIG. 2, a projected object 26A might run into bottle 28A, lose velocity, and incorrectly drop into near bin 30A.

The cross air current 50 offsets these friction forces by helping all of these objects to flow along the trajectory path 34A at the same speed. The cross air current 50 in FIG. 5 also provides more separation of material launched off the conveyor 24. For example, the cross air current 50 may blow the object 26A off of bottle 28A thus helping the object 26A continue along trajectory path 34 into the desired far bin 30B.

Pneumatic Transfer

Figure 6:
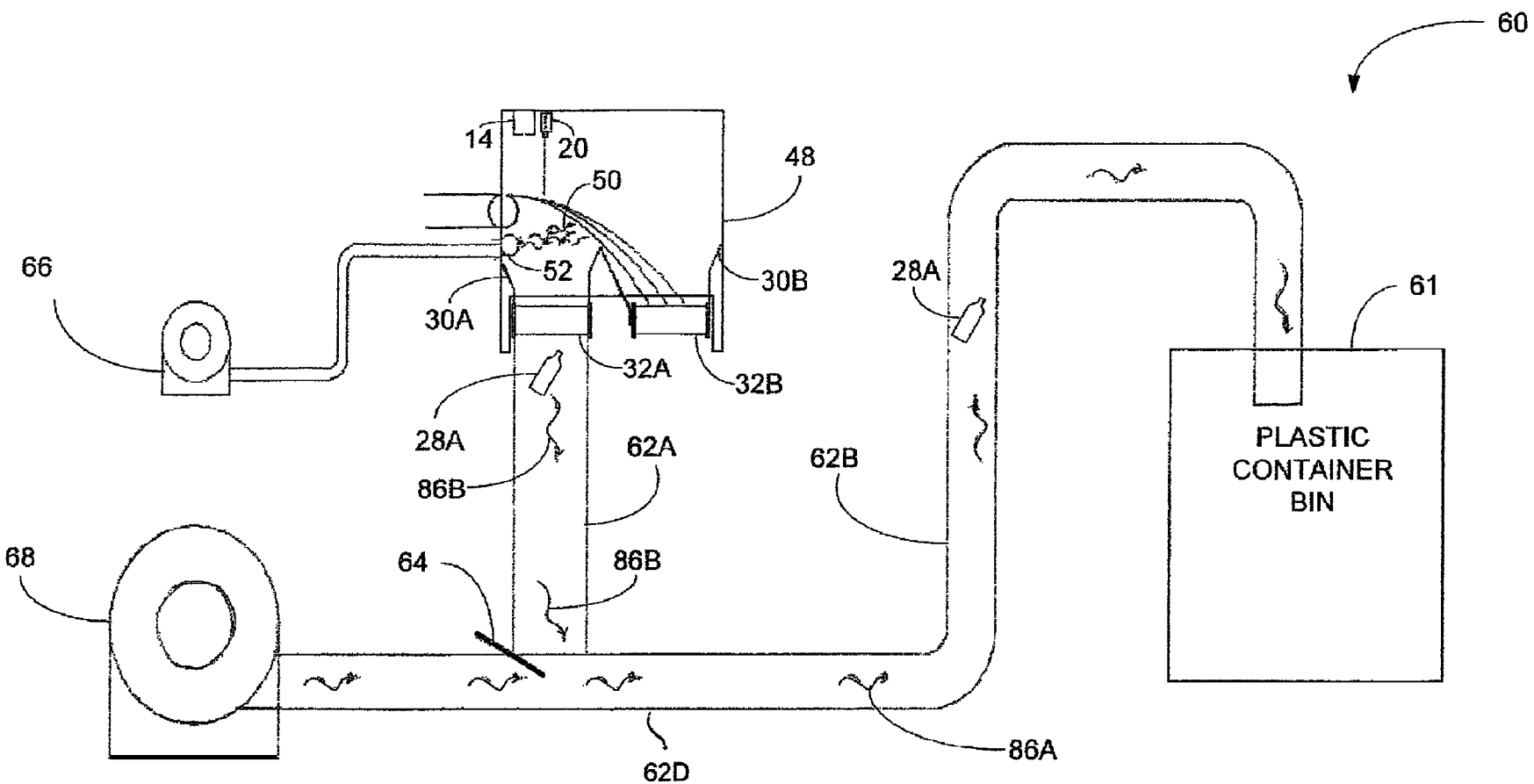
FIG. 6 shows a pneumatic transport system used in combination with the cross flow air separation system.

FIG. 6 shows a pneumatic transfer system 60 used for transporting the PET and/or HDPE objects 28, such as plastic bottles, from the cross air current separation system 48 to a storage bin 61. The pneumatic transfer system 60 includes a blower 68, air flow controller (venturi) 64, and a series of air chambers (pipes) 62. The air flow controller 64 in one embodiment is a metal plate or door that can be either rotated about the side of the pipe 62 and/or slid back and forth inside of air chamber 62.

The plastic bottles 28A are blasted down into near bin 32A by the ejection air nozzle 20 as described above. Attached to the bottom of the near bin 32A is a vertical air chamber 62A. This air chamber transports the material via gravity and potentially other pneumatic forces depending on how the system is tuned, down to the main horizontal air chamber #62D. Once the objects 28A transfer into air chamber 62D, the air 86A from blower 68 carries the objects 28A up through air chamber 62B into bin 61.

Due to the nature of the pneumatic transfer system 60, the air flow 86A going through the venturi 64 can create a vacuum in vertical air chamber 62A. The downward air flow 86B created by the vacuum can undesirably draw relatively light material down into the near bin 30A. The cross air current 50 offsets some of this downward air flow 86B further allowing material to travel over near bin 30A and drop into far bin 30B.

Figure 7:
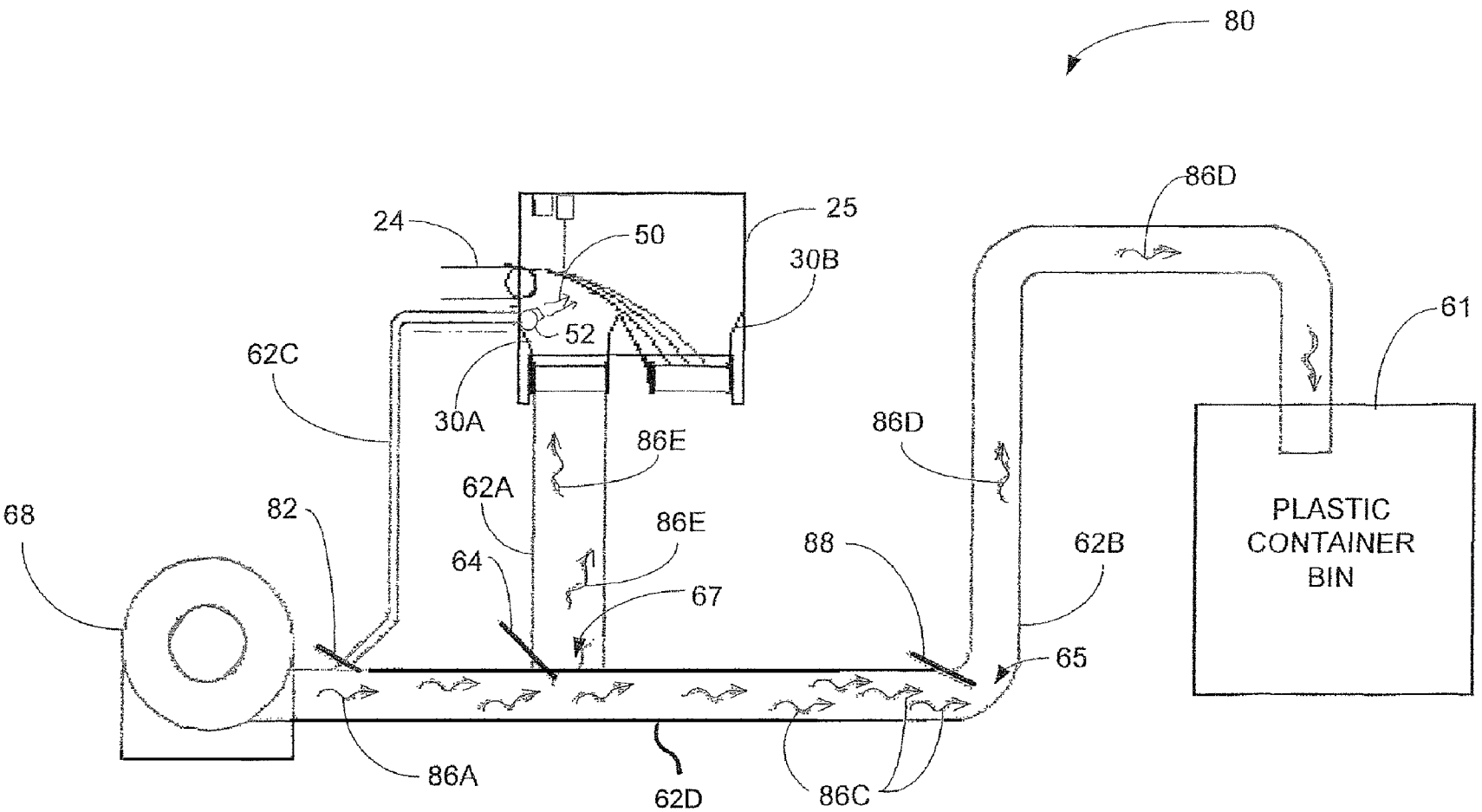
FIG. 7 shows another embodiment of the pneumatic transport system that uses a venturi system to compensate for downward air pressure.

FIG. 7 shows an alternative pneumatic transfer system 80 that provides more balanced air flow. The pneumatic transfer system 80 includes a second air flow controller (venturi) 88 located at the L-shaped horizontal to vertical elbow section between air chamber 62D and air chamber 62B. Depending on the nature of material and air flow characteristics, the second air flow controller 88 can be located in other locations in air chamber 62B. Air flow controller 88 in one embodiment is a metal plate or door that rotates between air chamber 62D and air chamber 62B.

The two air flow controllers 64 and 88 control the amount of air allowed to pass through air chambers 62A, 62B, and 62D respectively, by varying the size of the opening in the air chambers 67 and 65, respectively. The second air flow controller restricts air flow 86C through the air chamber 62B causing back pressure back up into air chamber 62A. The back pressure eliminates some or all of the previous downward air flow 86B (FIG. 6) previously created by the vacuum in air chamber 62A.

The combination of air flow controllers 64 and 88 can further be arranged so that a positive upward air flow 86E blows back up through air chamber 62A into the near bin 30A. This positive upward air pressure 86E can work separately, or in combination with cross air current 50, to help carrying light material over near bin 30A and into the far bin 30B. As the opening 65 between air chamber 62D and air chamber 62B is made smaller by air flow controller 88, more back pressure air flow 89E is created in air chamber 62A. Additional positive upward air flow 86E can be created by further reducing the size of the opening 65 with air flow controller 88 and/or increasing the size of the opening 67 in air chamber 62A with the air flow controller 64.

In another embodiment, another air chamber (pipe) 62C taps off of pipe 62B at the main outlet of the blower 68 and provides the air flow for the cross air current 50 output by the air knife 52. A third air flow controller (venturi) 82 is located in pipe 62C and is used for controlling the amount of cross air current 50 output by air knife 52.

The same blower 68 can be used for providing the cross air current 50 to air knife 52 and for generating the air flows 86 in air chambers 62A 62B and 62D. Using the same air supply from blower 68 self balances the different air flows 50, 86A, 86B, and 86C.

For example, it is easier to adjust or synchronize multiple different air flows when they all originate from a common air supply 68. Since there is one common air supply used for all of these air flows, increasing the cross air current 50 coming from air knife 52, for example, will correspondingly reduce some of the air flow 86A. This in turn can reduce the upward air flow 86E in air chamber 62A. Similarly, reducing the amount of air allowed into air chamber 62C can increase the amount of positive air flow 86E moving vertically up from air chamber 62A. Accordingly, the entire air control system self balances to provide more predictable material trajectory and transfer control.

Having described and illustrated the principles of the invention in a preferred embodiment thereof, it should be apparent that the invention may be modified in arrangement and detail without departing from such principles. I/we claim all modifications and variation coming within the spirit and scope of the following claims.

The invention claimed is:

1. A material separation system, comprising:

a conveyor configured to project material out over an end of the conveyor generally along a trajectory path into a first far receiving location;

a sensing system configured to identify particular objects in the projected material;

an air ejection system configured to generate a first airstream that ejects the identified objects from the trajectory path into a second near receiving location; and a pneumatic transfer system comprising:

a first air chamber configured to receive the identified objects ejected into the second near receiving location;

a second air chamber coupled between the first air chamber and an output;

a blower configured to generate an air flow that pneumatically transports the identified objects from the first air chamber, through the second air chamber, and to the output; and an air flow control system that creates a back pressure in the second air chamber.

2. The material separation system according to claim 1 further comprising a cross air current system configured to generate a second airstream that reduces air resistance for the material projected along the trajectory path, wherein the cross air current system is configured to counteract air turbulence created by the first airstream, improve aerodynamics of the projected material, and offset frictional forces exerted on the projected material.

3. The material separation system according to claim 1 wherein:

the trajectory path extends out from the conveyor in a substantially horizontal and then downwardly arching direction; and the first airstream blasts the identified objects vertically downward into the second near receiving location while at least some of the other material continues along the trajectory path towards the first far receiving location.

4. The material separation system according to claim 2 wherein the cross air current system directs the second airstream along the trajectory path.

5. The material separation system according to claim 4 wherein the cross air current system produces the second airstream at approximately a same mid-air speed as the material projected out from the conveyor.

6. The material separation system according to claim 1 wherein the material substantially comprises a material stream and the identified objects in the material stream that are ejected from the trajectory path include plastic containers.

7. The material separation system according to claim 1, wherein the air flow control system is further configured to divert at least some of the air flow generated by the blower from the second air chamber into the first air chamber, wherein the back pressure at least partially counteracts a vacuum normally created in the first air chamber.

8. The material separation system according to claim 1 wherein the pneumatic transfer control system further comprises a first air passage door controlling an amount of air allowed to pass into the first air chamber and a second air passage door controlling an amount of air allowed to pass through the second air chamber.

9. The material separation system according to claim 2 wherein the pneumatic transfer system further comprises a third air chamber coupled between the blower and the cross air current system, and wherein the blower is configured to both generate the air flow that carries the identified objects into the output and provide an air flow in the third air chamber that the cross air current system uses to generate the second airstream.

10. A method, comprising:

projecting materials along a trajectory path;

identifying particular objects in the materials;

generating a first airstream that blasts the identified objects out of the trajectory path;

receiving the objects blasted from the trajectory path by the first airstream;

pneumatically transporting the received objects through one or more air chambers to an output; and creating a back pressure in the one or more air chambers that at least partially counteracts a vacuum created in the one or more air chambers.

11. The method according to claim 10 further comprising generating a second airstream that aids the projected materials in maintaining projection generally along the trajectory path while the first airstream blasts the identified objects out of the trajectory path.

12. The method according to claim 11 wherein the second airstream reduces air turbulence created by the first airstream and offsets frictional forces exerted between materials while traveling along the trajectory path.

13. The method according to claim 10 further comprising:

projecting the materials horizontally outward along the trajectory path so that the material falls into a first far bin; and blasting air vertically downward moving the identified objects downward from the trajectory path into a second near bin.

14. The method according to claim 11 further comprising generating the second airstream at approximately a same speed as a projection speed of the materials traveling along the trajectory path.

15. The method according to claim 10 wherein the back pressure in the one or more air chambers diverts an air flow from a blower past the received objects and aids the projected materials in maintaining the projection generally along the trajectory path while the first airstream blasts the identified objects out of the trajectory path.

16. The method according to claim 15 including using the air flow from the same blower to both generate a second airstream and transport the identified objects to the output.

17. A system for separating objects from a material stream, comprising:

a transport mechanism configured to project the material stream out over a trajectory path;

a first receiving device aligned with an end of the trajectory path for receiving the projected material stream;

an image sensor configured to identify the objects in the material stream;

a first air projection device coupled to the image sensor configured to exert a first airstream into the identified objects that pushes the identified objects out of the trajectory path;

a second receiving device configured to receive the identified objects pushed out of the trajectory path by the first air projection device;

a first pipe for receiving the identified objects blown into the second receiving device;

a second pipe coupled between the first pipe and an output;

a pneumatic device configured to generate an air flow that pneumatically transports the identified objects from the first pipe, through the second pipe, and into the output; and an air flow control system that creates a back pressure in the second pipe.

18. The system according to claim 17 wherein the back pressure in the second pipe is configured to divert at least some of the air flow generated by the pneumatic device from the second pipe into the first pipe.

19. The system according to claim 17 further comprising a second air projection device configured to output a second airstream that intersects the first airstream and reduces air resistance along the trajectory path for the projected material stream.

20. The system according to claim 19 further comprising a third pipe that supplies air from the pneumatic device to the second air projection device for producing the second airstream.

* * * * *